US007727010B2

(12) United States Patent
Liu et al.

(10) Patent No.: US 7,727,010 B2
(45) Date of Patent: Jun. 1, 2010

(54) ELECTRICAL CONNECTOR

(75) Inventors: Tian-Hong Liu, Kunshan (CN); Chi Zhang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/009,203

(22) Filed: Jan. 17, 2008

(65) Prior Publication Data

US 2008/0171460 A1 Jul. 17, 2008

(30) Foreign Application Priority Data

Jan. 17, 2007 (CN) ..... 2007 1 0019591

(51) Int. Cl.
*H01R 13/60* (2006.01)

(52) U.S. Cl. ..... 439/570; 439/83; 439/495

(58) Field of Classification Search ..... 439/495, 439/260, 569, 570, 83
See application file for complete search history.

(56) References Cited

U.S. PATENT DOCUMENTS 6,203,345 B1 * 3/2001 Roque et al. ..... 439/260
6,227,907 B1 * 5/2001 Wu et al. ..... 439/570
6,254,406 B1 7/2001 Chiu et al.
6,921,274 B2 * 7/2005 Yu ..... 439/260
7,255,594 B2 * 8/2007 Huang et al. ..... 439/495
7,258,567 B2 * 8/2007 Tanaka et al. ..... 439/355
7,291,039 B2 * 11/2007 Shin ..... 439/495
7,357,663 B2 * 4/2008 Wei et al. ..... 439/495
2006/0014424 A1 * 1/2006 Jin ..... 439/570
2008/0160818 A1 * 7/2008 Liu et al. ..... 439/345

* cited by examiner

*Primary Examiner*—Xuong M Chung-Trans
(74) *Attorney, Agent, or Firm*—Andrew C. Cheng; Wei Te Chung; Ming Chieh Chang

(57) ABSTRACT

An electrical connector (100) for connecting a sheet-like connection member includes an insulating housing (1) provided with a plurality of conductive terminals (2, 3) and a pair of retaining members. The housing defines a pair of slots (15) each with an upper groove (153) and a lower groove (154) at a front portion thereof. The retaining members (4) are embedded in the slots (15), and each comprises an upper arm (441) retained in the upper groove (153), a lower arm (442) received in the lower groove (154) and a soldering portion (42) extending from a bottom edge thereof. The lower groove (154) runs though the housing in an insertion direction of the retaining members (4).

1 Claim, 9 Drawing Sheets

ELECTRICAL CONNECTOR

BACKGROUND OF THE INVENTION

1. Field of the Invention

The present invention relates to an electrical connector, and more particular to an electrical connector for a sheet-like connection member such as a flexible printed circuit (FPC), a flexible flat cable and so forth. All of these cables and circuit hereafter will be generally referred to as "FPC" for simplification.

2. Description of Related Art

U.S. Pat. No. 6,921,274 discloses a conventional electrical connector adapted for connecting an FPC. The longitudinal insulating housing of the connector defines a pair of slot respectively at opposite ends thereof. The back portion of the slot is between the top and bottom of the housing, and the front of the slot is running though the top and bottom face of the housing. A pair of retaining member has a forward-extending retaining portion retained in the front portion of the slot and a solder portion extending from the bottom edge thereof and out of the housing. The solder portion can only extend from the bottom edge except the retaining portion.

When the electrical connector is mounted onto a printed circuit board (PCB), the connector is often appointed at a predetermined place on the PCB. However, the retaining member is often made in different shape or size due to different needs, sometimes the soldering portion of the retaining member could not be soldered on a predetermined place of the PCB because of the restriction of the slot, which is not advantage for meeting the diversity needs of the user. Therefore, an improved electrical connector is required to overcome the problem.

SUMMARY OF THE INVENTION

An object of the present invention is to provide an electrical connector with an improved retaining member.

In order to achieve above-mentioned objects, an electrical connector comprises an insulating housing provided with a plurality of conductive terminals, defining a pair of slots each with an upper groove and a lower groove at a front portion thereof; a pair of retaining members embedded in the slot, each comprising an upper arm retained in the upper groove and a lower arm received in the lower groove, and a soldering portion extending from a bottom edge thereof; wherein the lower groove runs through the housing in an insertion direction of the retaining members.

Other objects, advantages and novel features of the present invention will become more apparent from the following detailed description of the present embodiment when taken in conjunction with the accompanying drawings.

DETAILED DESCRIPTION OF THE INVENTION

Figure 1:
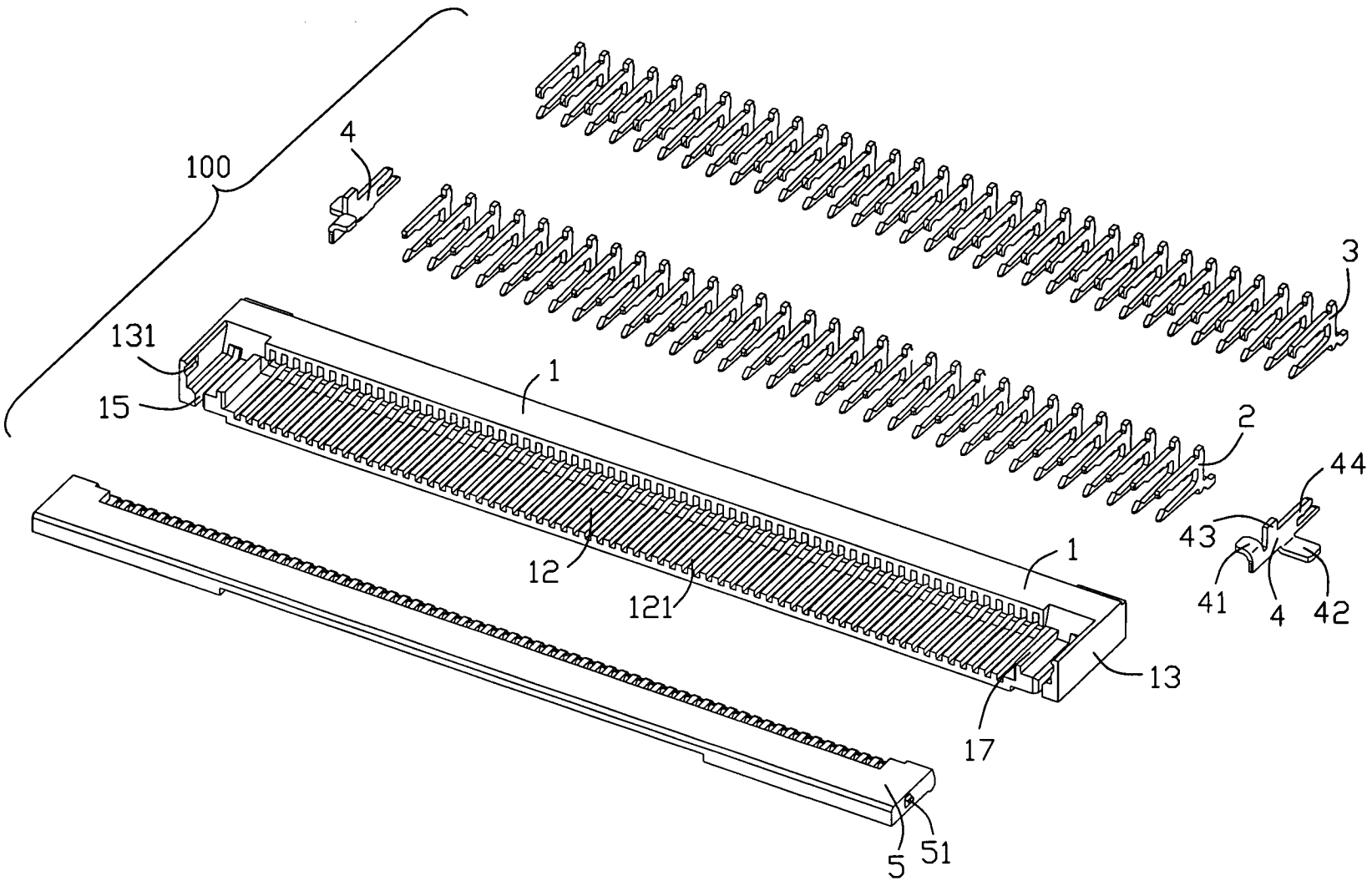
FIG. 1 is an exploded perspective view of an electrical connector in accordance with the present invention.

Reference will now be made to the drawing figures to describe the preferred embodiment of the present invention in detail.

Figure 2:
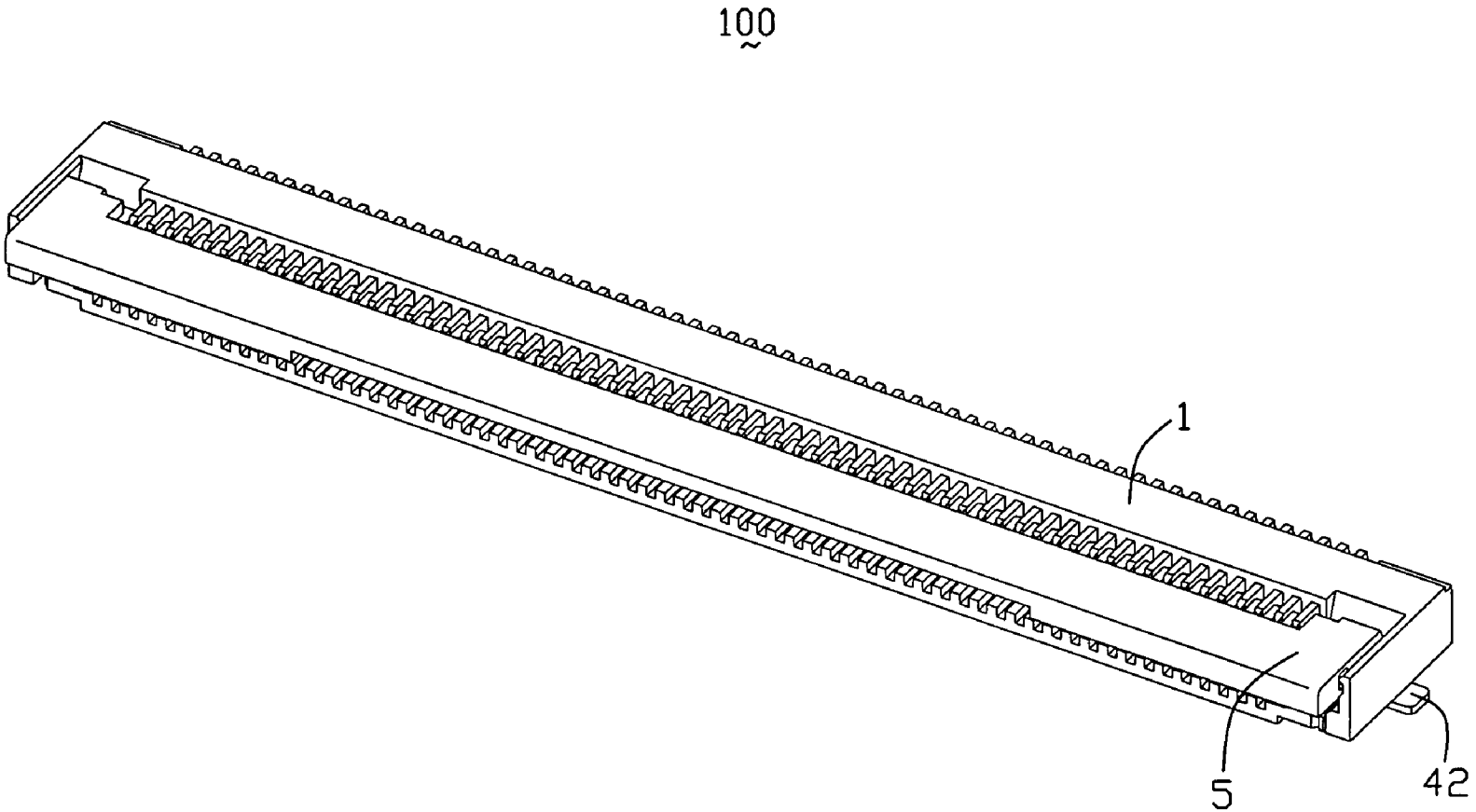
FIG. 2 is an assembled perspective view of the electrical connector.

Referring to FIGS. 1 and 2, an electrical connector 100 in accordance with the present invention comprises an insulating housing 1, a plurality of first terminals 2 and second terminals 3 received in the housing 1, a pair of retaining members 4 embedded in the housing 20 and an actuator 5 rotatablely mounted on the housing 1.

Referring to FIG. 1, the housing 1 of elongated shape defines a cavity 12 opened upward and forward at one side thereof with two opposite sidewalls 13. A pair of supporting ribs 17 respectively extends upward from the top face of the cavity 12 in a front-to-back direction (i.e. an insertion direction) to divide the cavity 12 into three parts. The middle part of the cavity is used to receive a corresponding FPC and defines a plurality of passageways 121 parallel arranged along an elongated direction perpendicularly to the front-to-back direction and running through the rear end of the housing 1. A slot 15 extends from the front face to the rear face of the housing in the front-to-back direction between the rib 17 and the sidewall 13.

Figure 4:
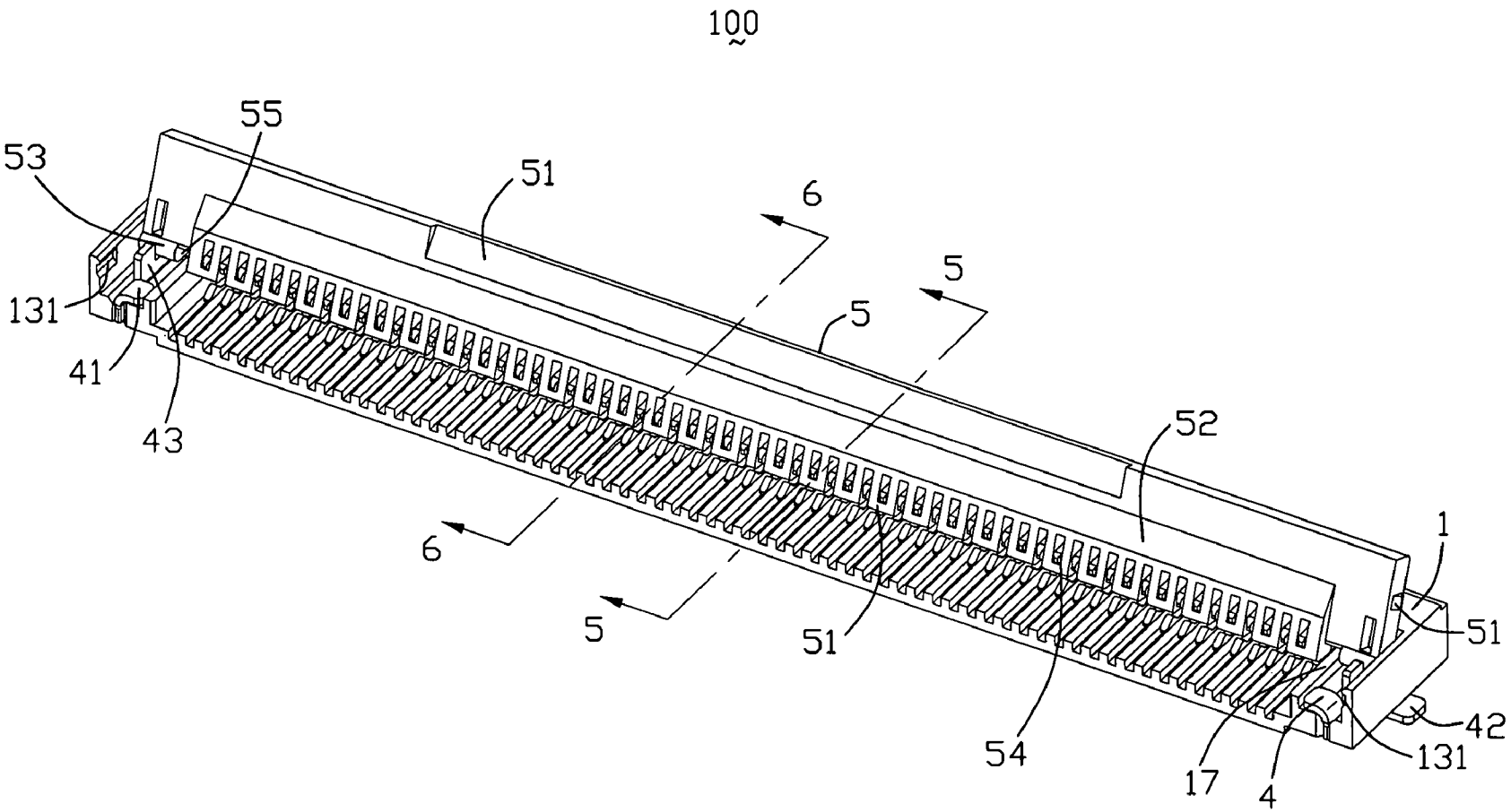
FIG. 4 is an assembled perspective view of the electrical connector wherein an actuator is in an open position.
Figure 5:
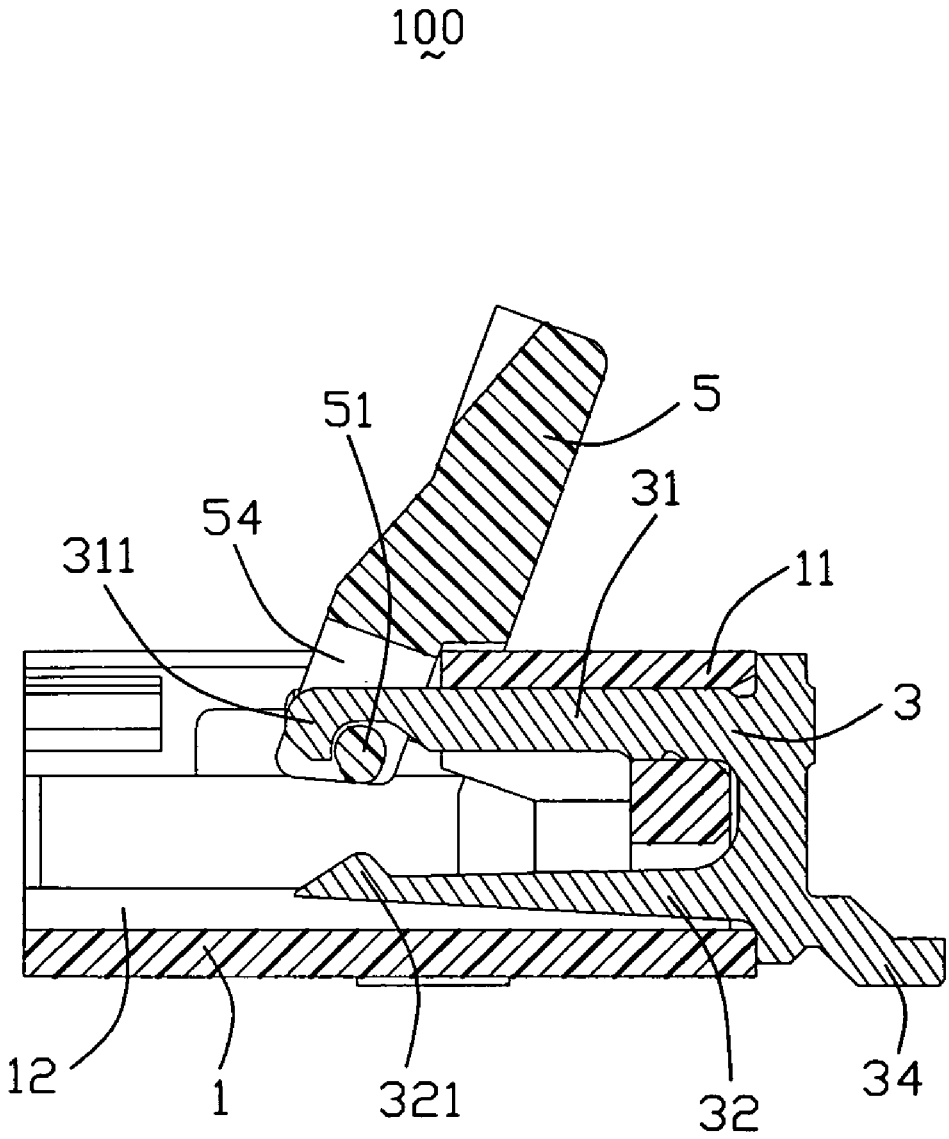
FIG. 5 is a cross-sectional view of FIG. 3 taken along line 5-5.
Figure 6:
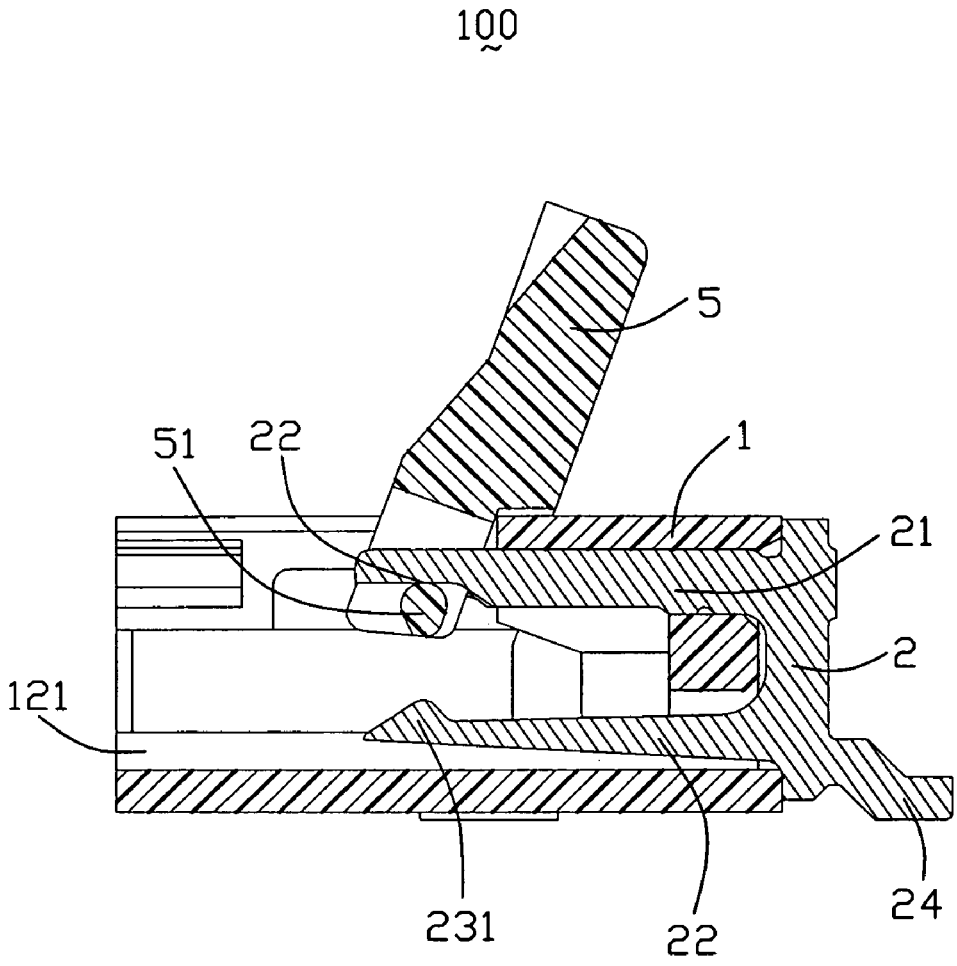
FIG. 6 is a cross-sectional view of FIG. 3 taken along line 6-6.

Referring to FIGS. 1 and 4, the first and second terminals 2, 3 are retained in the passageways 121 and the actuator 5 is assembled in the cavity 12. The actuator has a plurality of receiving holes 54 formed at one side thereof and each receiving hole is used to receive an upper arm of the terminal. See FIG. 5, each second terminal 3 comprises an upper arm 31 with a hook portion 311 facing the cavity 12, a lower arm 32 opposite the upper arm with a contacting portion 321 projecting to the cavity and a soldering portion 34 extending out of the housing. The hook portion 311 passes through the receiving hole 54 and grasps a shaft 51 in the hole so the actuator 5 can rotate along the shaft relative to the top of the cavity. See FIG. 6, the first terminal 2 is similar to the second terminal 3, and comprises an opposite upper arm 21 and a lower arm 22 and a soldering portion 24 extending out of the housing. A contacting portion 221 is formed at a distal end of the lower arm 22 facing the cavity 12. The upper arm of the first terminal has no hook portion, which is different from the second terminal 2.

Referring to FIG. 4, the actuator 5 is of an elongated board and said receiving holes 54 are formed on a comb portion 52 which is disposed at one side of the actuator for urging the FPC. A pivot portion 53 is defined at both end of the comb portion 52 and spaced away the comb portion with a groove 55 for receiving the rib 17. The pivot portion 53 is installed into the side cavity between the rib 17 and the sidewall 13 upon the retaining member 4, which will be detailed described hereinafter. A pair of protrusions 57 is formed on both ends of the board respectively. When the actuator 5 is rotated to a closed position, the protrusions 57 will buckle with a receiving recess 131 formed on the upper portion of the inner sidewall 13.

Figure 7:
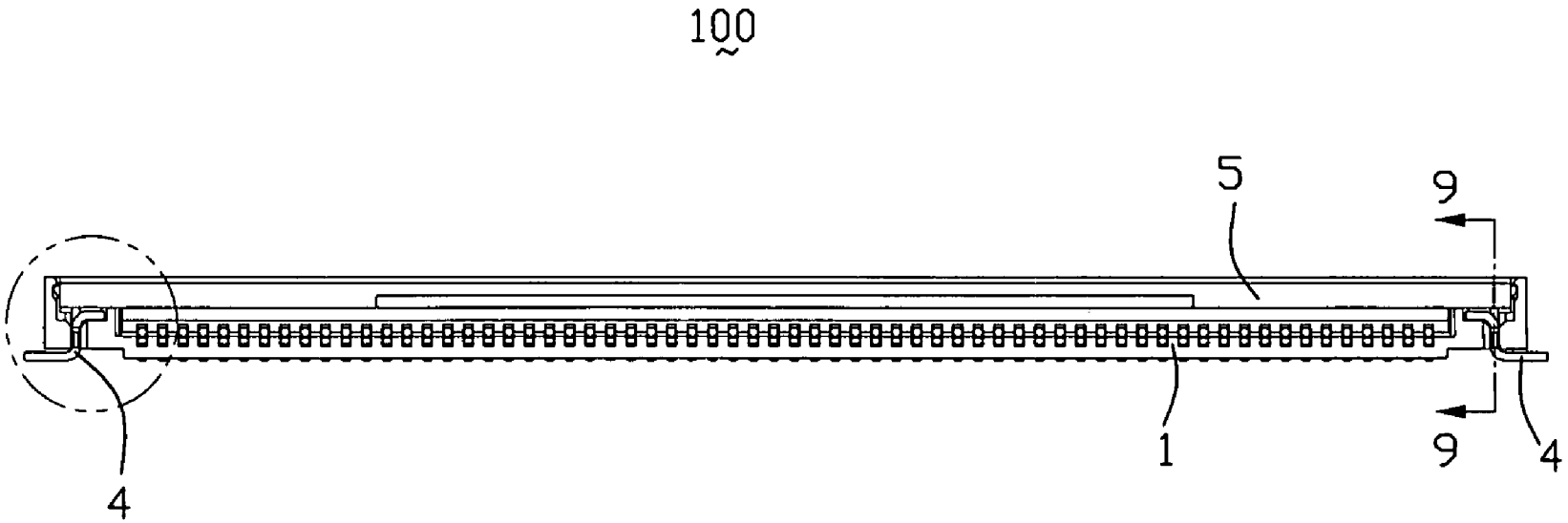
FIG. 7 is a front view of the electrical connector shown in FIG. 2.
Figure 8:
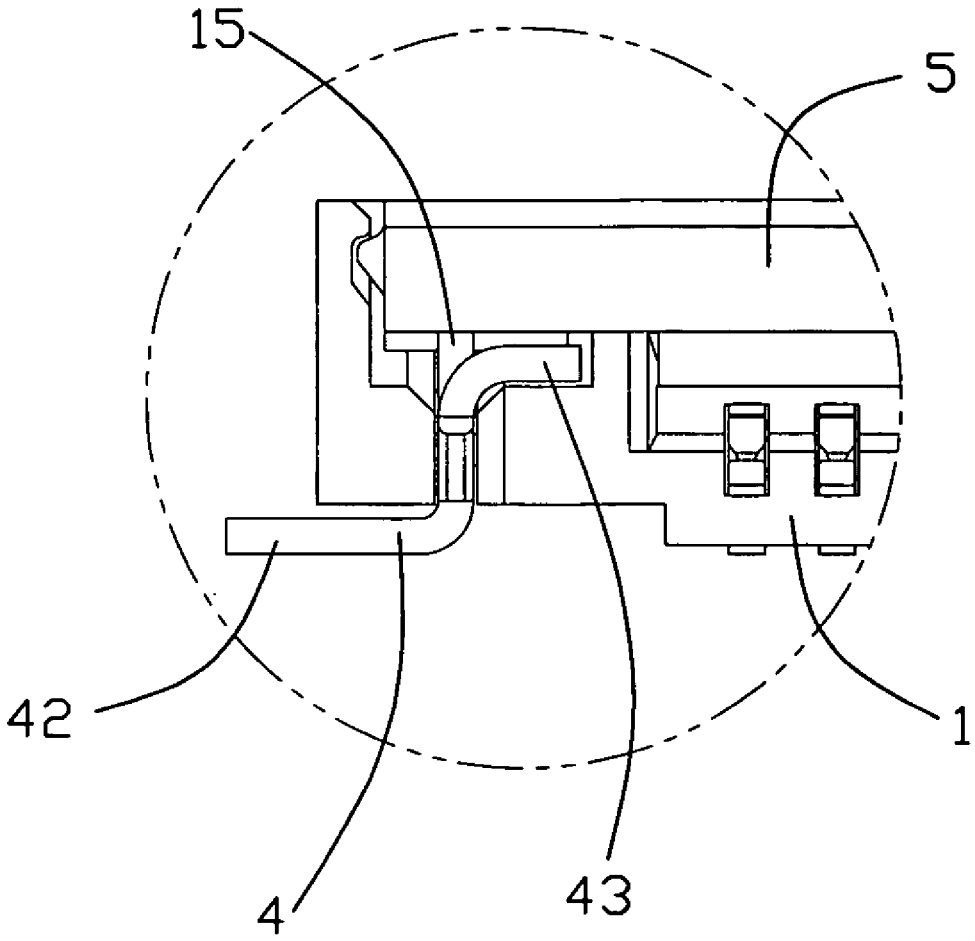
FIG. 8 is a partly-amplificatory view of the electrical connector shown in FIG. 7.

Referring to FIGS. 1 and 4, the retaining member is made from a metal sheet and is retained in the slot 15 by the retaining portion 44. The retaining member 4 is provided with a stopping portion 43 extending upward from the top edge thereof, which can prevent the pivot portion 53 of the actuator from forward moving while the pivot portions are supported by the top edge of the retaining member. A bending portion 41 is bent inward and abutting against the inside bottom of the cavity 12. A solder portion 42 is bent outwardly and along the bottom of the housing. The bending portion and the solder portion are extending in an adverse direction (see FIGS. 7 and 8), which decrease exterior force exerted on the housing. The work theory of the actuator 5 is common acknowledge for the people in the field, so the detail description about it is omitted.

Figure 3:
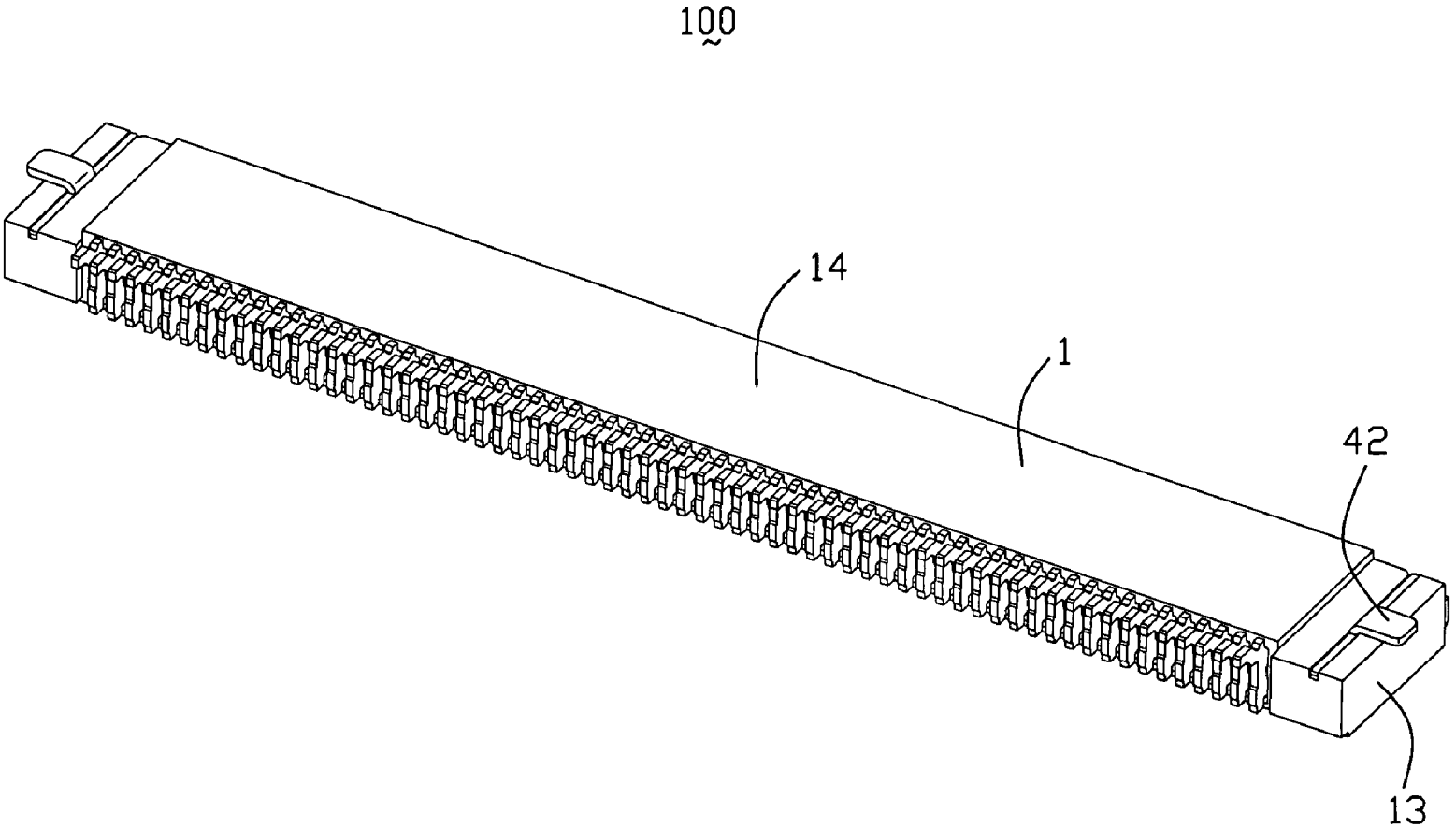
FIG. 3 is another view of the electrical connector shown in FIG. 2.
Figure 9:
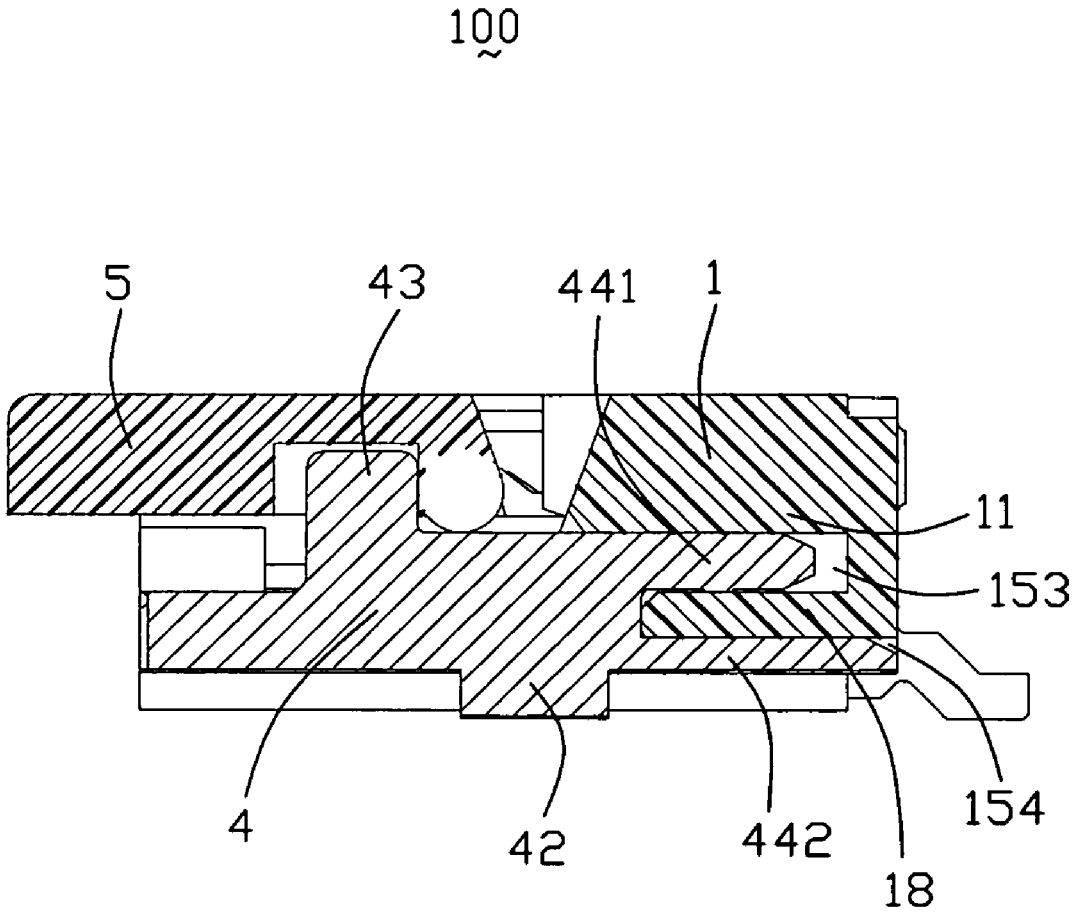
FIG. 9 is a cross-sectional view of FIG. 7 taken along line 9-9.

Referring to FIGS. 1 and 9, the rear portion of the slot 15 are divided into two portions by a partition 18 unitarily formed with the housing, an upper groove 153 and a lower groove 154 parallel to the upper groove. The lower groove 154 is running through the back wall of the housing and open to the bottom of the housing. The retaining portion is in a fork like shape and comprises an upper arm 441 and a lower arm 442. The upper arm 441 is retained in the upper groove 153 and the lower arm 442 is received in the lower grooves 154 and exposed to the outer of the housing. The solder portion 42 is extending from the bottom edge of the retaining member. Best shown in FIG. 3, the solder portion 42 can selectively extend from the bottom edge, especially from the bottom edge of the lower arm 442 since the lower groove 154 is completely running through the housing. The retaining member 4 is retained mainly by the upper arm 441. The lower arm may also be retained in the lower groove 154.

The present invention is not limited to the electrical connector mentioned above. This disclosure is illustrative only, changes may be made in detail, especially in matter of shapes, size, and arrangement of parts within the principles of the invention.

What is claimed is:

1. An electrical connector comprising:

an insulative housing provided with a plurality of conductive terminals, and defining a pair of slots at two opposite ends of the housing, each with an upper groove and a lower groove, and a bottom face of two sections of the housing in communication with the lower groove; and a pair of retaining members embedded in and forwardly assembled into the corresponding slots, each comprising an upper arm retained in the upper groove and a lower arm received in the lower groove, and a solder portion extending from a bottom edge of the lower arm; wherein the lower groove runs through the housing in a vertical direction of the housing along essentially a full length of the bottom face of said housing in a front-to-back direction under a condition that a front end of the lower arm essentially reaches a front face of the housing so as to allow the soldering portion to be able to selectively extend from any position of the bottom edge of the lower arm for compliance with a corresponding solder pad on a printed circuit board on which the connector is seated;

wherein both said upper groove and said lower groove are aligned with each other in vertical plane;

wherein a level of said lower groove is higher than that of the solder portion.

* * * * *